United States Patent [19]

Lukaszewicz

[11] Patent Number: 4,476,603

[45] Date of Patent: Oct. 16, 1984

[54] DRAINAGE SEAL FOR SEWAGE SYSTEM

[75] Inventor: George Lukaszewicz, Montreal, Canada

[73] Assignee: Shell Canada Limited, Toronto, Canada

[21] Appl. No.: 504,858

[22] Filed: Jun. 16, 1983

[51] Int. Cl.[3] ..... B08B 9/02

[52] U.S. Cl. ..... 15/104.3 SN; 15/104.05; 15/257 R

[58] Field of Search ..... 15/104.3, 104 R, 104.05, 15/257 R; 277/11, 237 R

[56] References Cited

U.S. PATENT DOCUMENTS 4,405,135 9/1983 Ries ..... 277/11
4,422,209 12/1983 Djordeuig ..... 15/104.3 SN

FOREIGN PATENT DOCUMENTS 565947 11/1958 Canada ..... 15/104.3 SN
93470 11/1938 Sweden ..... 15/104.3 SN

*Primary Examiner*—Robert I. Smith
*Attorney, Agent, or Firm*—Fleit, Jacobson, Cohn & Price

[57] ABSTRACT

To facilitate cleanout of a sewer a guide member is located with a manhole to guide a cleanout tool into the sewer. The sewer is downwardly inclined adjacent the manhole so that the inlet enters at a location below the outlet and a predetermined level of liquid is maintained in the manhole. The guide member comprises a base with a pair of upstanding wings that project above the predetermined level to present a pair of guide members for the insertion of the cleanout tool.

8 Claims, 7 Drawing Figures

DRAINAGE SEAL FOR SEWAGE SYSTEM

Figure 1:
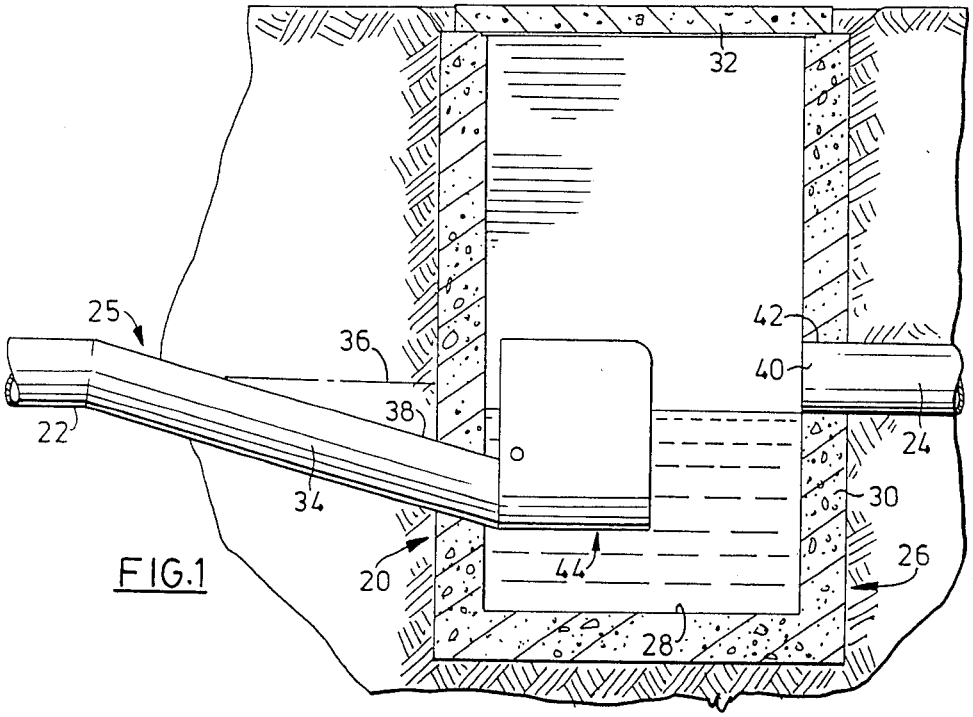

The present invention relates to sewer and drainage installations and more particularly to the manholes used to divide such installations into discrete sections.

Sewer and drainage systems for removing effluent or ground water are conventionally separated into discrete sections by manholes. These manholes are provided to allow access to the sewer pipe for cleaning and maintenance purposes. In some installations, for example in a refinery, it is necessary for the sections of the sewer to be isolated from one another so that fire or noxious gases are prevented from spreading along the sewer system. This isolation is usually accomplished by means of a liquid seal in the manhole.

The conventional manner of obtaining such a liquid seal is to provide an elbow on the inlet duct so that it projects towards the floor of the manhole below the level of the outlet. In this way the exit from the elbow is always maintained below the level of liquid in the manhole so that the required liquid seal is provided.

It is however frequently necessary to gain access to the sewer, either to perform routine maintenance such as flushing the interior of the sewer with clean water or to remove an obstruction that is blocking the sewer. With the conventional arrangements of manhole it is necessary to remove the elbow before the clean out hose or clean out tool is inserted into the inlet duct. This requires the maintenance staff to enter the manhole, and remove the elbow. Because of the danger of noxious gases it is necessary for the maintenance staff to utilise breathing apparatus and the performance of the person in the manhole has to be monitored by other personnel to ensure the work is conducted safely. This is not only a hazardous operation but is also labour intensive and very time consuming.

It is therefore an object of the present invention to obviate or mitigate the above disadvantages.

According therefore to the present invention there is provided a manhole assembly to provide a liquid seal between two sections of a sewer comprising a floor, an upstanding peripheral wall, an inlet duct extending through said wall, an outlet duct extending through said wall at a location spaced from said inlet and having a portion located further from said floor than said inlet duct so as to maintain liquid in said manhole at a predetermined level sufficient to cover said inlet duct, and a guide member to facilitate entry of a cleaning tool into said inlet duct, said guide member comprising a base projecting from said inlet duct and having a pair of upstanding wings located on opposite sides of said base to project upwardly to a location above said predetermined level, said wings and base partially surrounding said inlet duct such that a cleaning tool inserted between said wings is guided by said base into said inlet duct.

According also to the present invention there is provided a manhole assembly for providing a liquid seal between two sections of a sewer, said manhole assembly comprising a sump having a floor and an upstanding peripheral wall, a circular inlet duct intersecting said wall at a first location, an outlet duct intersecting said wall at a second location spaced further from said floor than said inlet duct to maintain liquid in said sump at a pedetermined level, and a guide member connected to said inlet duct to facilitate entry of a cleaning tool therein, said guide member comprising a base conforming to the lower half of said inlet duct and a pair of plates connected to opposite edges of said base and projecting upwardly above said predetermined level.

Embodiments of the invention will now be described by way of example only with reference to the accompanying drawings in which FIG. 1 is a side sectional view of a manhole assembly.

Figure 2:
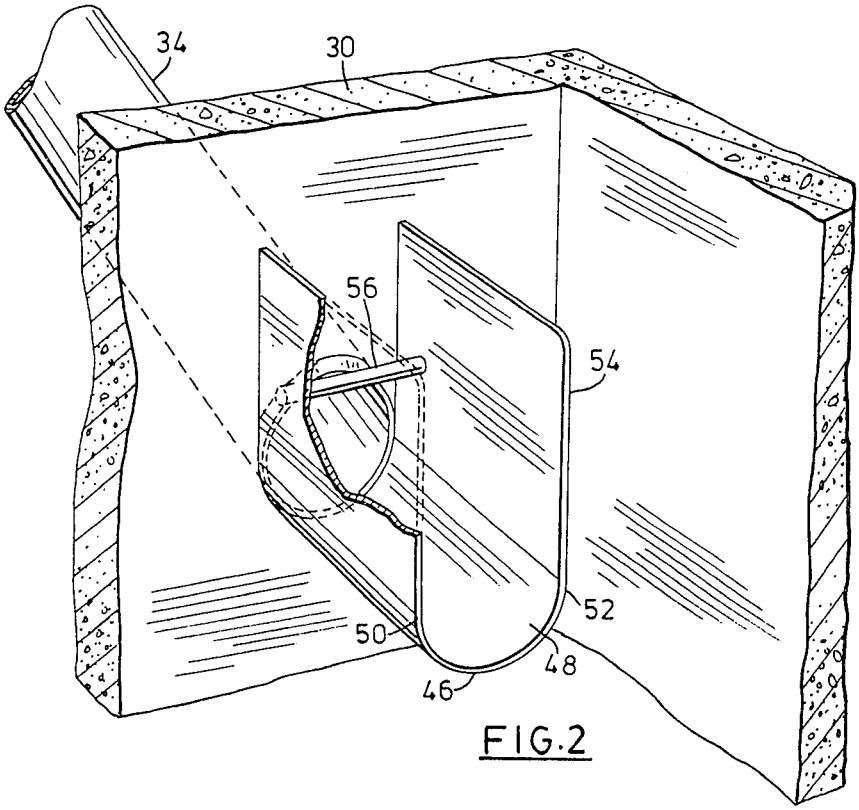
Figure 6:
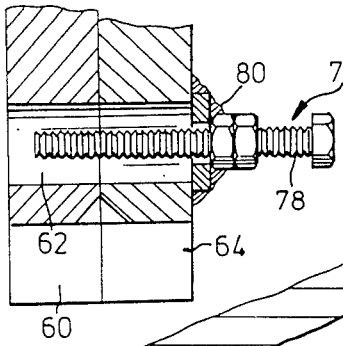
Figure 3:
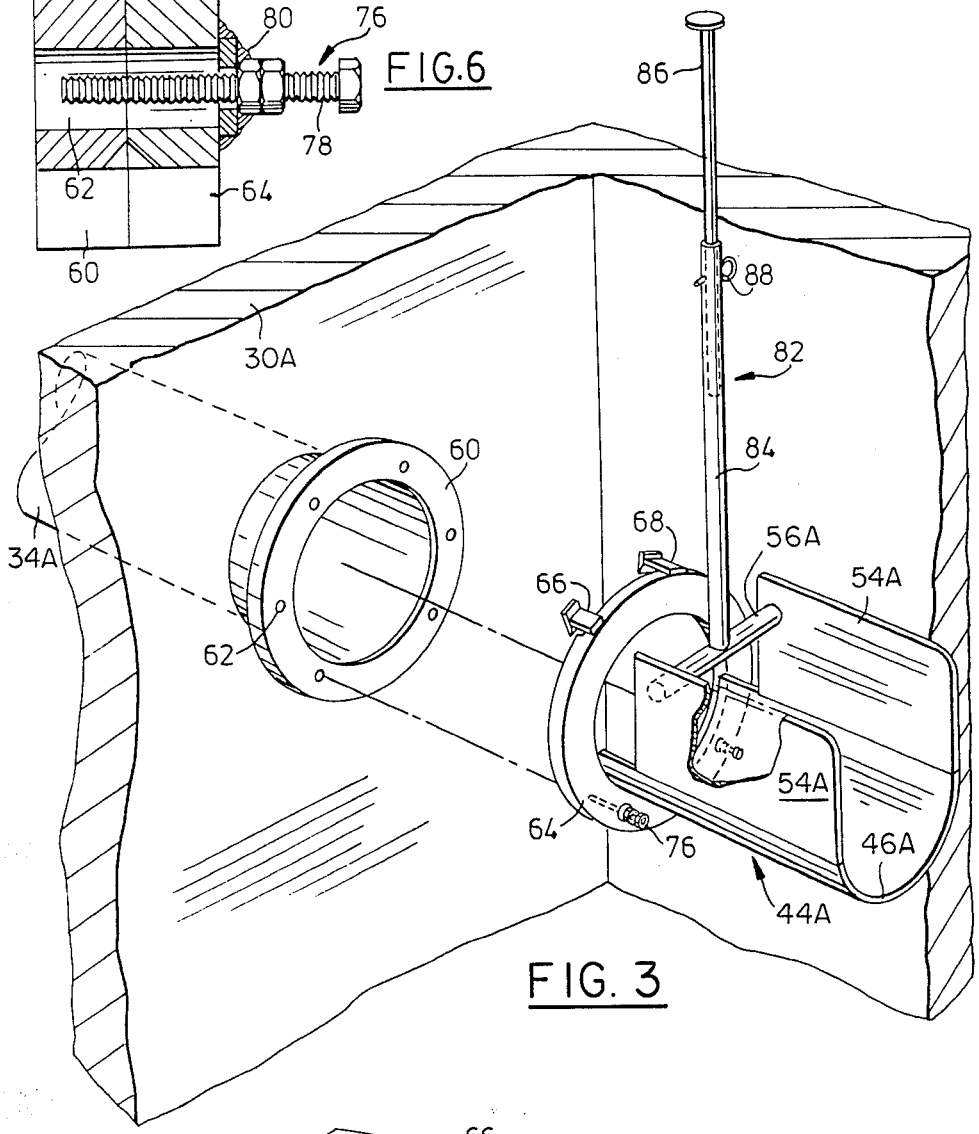
Figure 4:
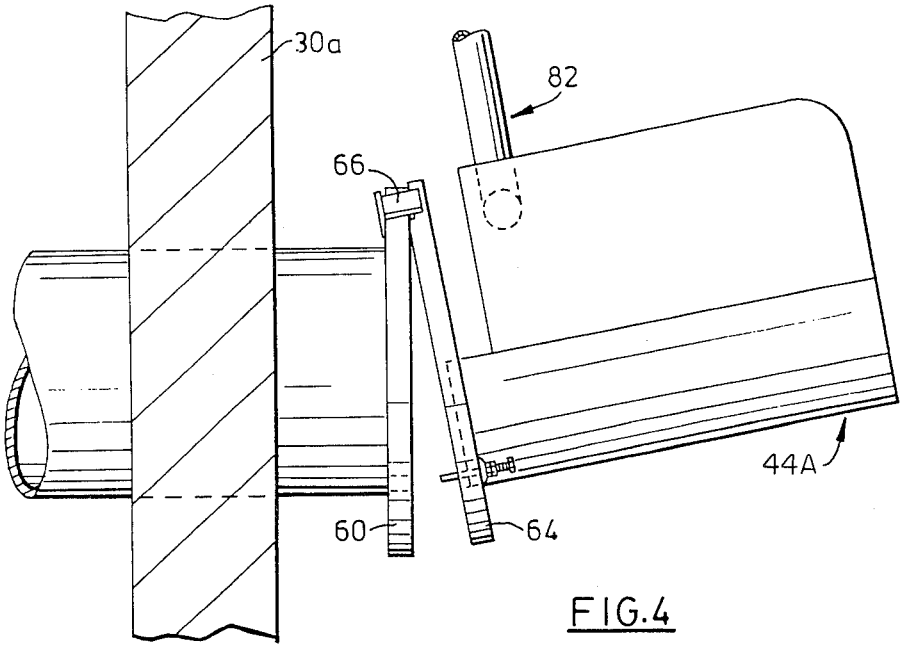
Figure 5:
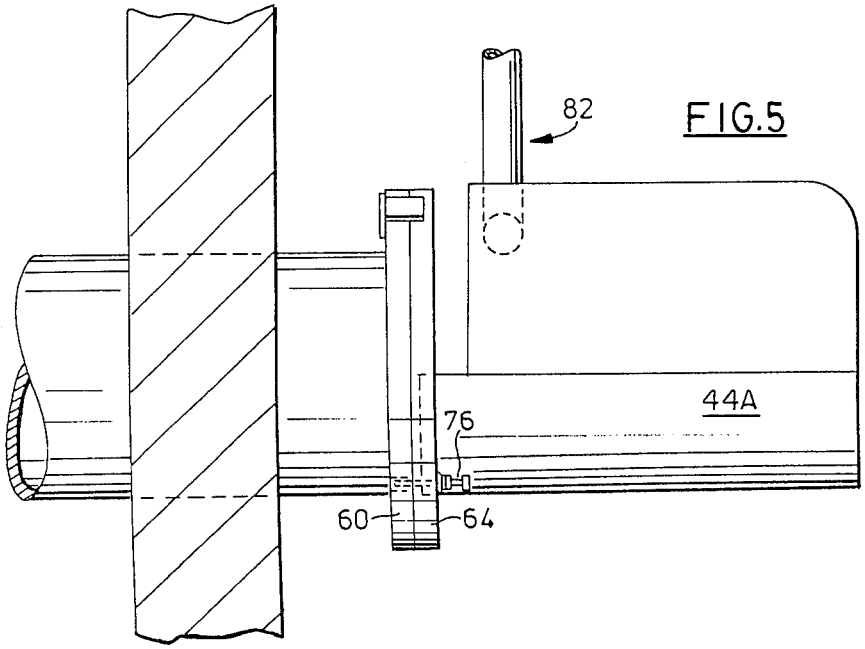

FIG. 2 is a perpective view of a portion of the manhole assembly shown in FIG. 1, FIG. 3 is a perspective view of a portion of a second embodiment of a manhole assembly, FIG. 4 is a side view of the embodiment of FIG. 4, showing components partially assembled, FIG. 5 is a view similar to FIG. 4 showing the components assembled, FIG. 6 is a section on the line 6—6 of FIG. 5.

Figure 7:
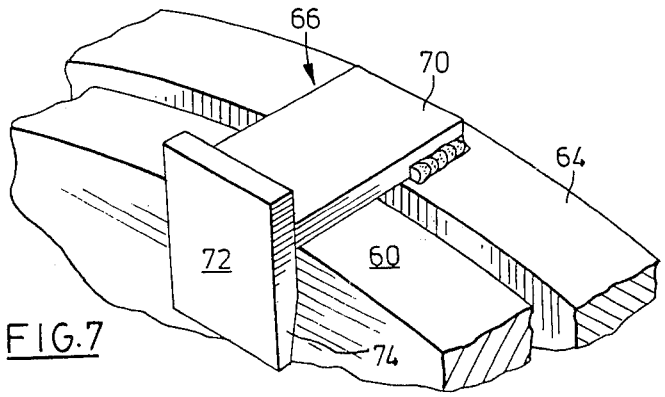

FIG. 7 is an enlarged perspective view of a portion of the assembly shown in FIG. 3, Referring now to the embodiment of FIGS. 1 through 3 a manhole assembly generally designated 20 is located between upstream and downstream sections 22–24 respectively of a sewer 25 extending along a common axis 36. The manhole assembly 20 includes a concrete sump 26 of generally square cross section having a floor 28 and an upstanding peripheral wall 30. A cover 32 is supported on the upper end of the wall 30 at grade level to enclose the sump 26.

The upstream section 22 of the sewer 25 includes an inlet duct 34 that is inclined downwardly at about 15° to the axis 36 of the sewer. The inlet duct 34 intersects the peripheral wall 30 at an aperture 38 and extends through the wall 30 to the interior of the sump 26 where it terminates parallel to the wall 30.

The downstream portion 24 of the sewer includes an outlet duct 40 that communicates with the interior of the sump through an aperture 42 in the wall 30. The aperture 42 is located further from the floor 28 than the aperture 38 and is usually aligned on the axis 36 of the sewer.

A guide member 44 is attached to the inlet duct 34 within the sump 26 and may best be seen in FIG. 2. The guide member includes a base 46 formed from a half section of pipe of similar diameter to the inlet duct 34 and welded to the inlet duct 34 so as to be supported parallel to the floor 28.

The base 46 has an internal surface 48 that terminates in horizontal planar surfaces 50–52. Attached to these planar surfaces 50–52 is a pair of guide wings 54 formed from plate material. The guide wings are conveniently welded to the base 46 and project upwardly from the base member to a location corresponding to the top of the outlet duct 40.

Extending between the wings 54 on a generally horizontal axis is a bar 56 of circular cross section that is located adjacent the inlet duct 34 and aligned with the uppermost portion of the inlet duct.

In operation liquid flowing from the upstream section 22 of the sewer flows into the sump 26 where it accumulates until it reaches the level of the outlet duct 40. From then on any surplus liquid will be drained by the outlet duct but a body of liquid will be maintained in the sump at a predetermined level corresponding to the height of the outlet duct from the floor 28. In this way the entry of the inlet duct 34 to the sump 26 always occurs below the liquid level so that a liquid seal is maintained between the upstream and the downstream sections of the sewer.

The wings 54 project above the liquid maintained in the sump 26 and present above the level of the liquid a pair of parallel plates to faciliate entry of a clean out tool into the inlet duct 34. Upon removal of the cover 32 a clean out tool, usually in the form of a high pressure hose, may be lowered between the wings 54 and pushed downwardly until it engages the internal surface 48 of the base 46. Further insertion of the clean out tool will force its leading edge into the inlet duct 34 and along the upstream section of the sewer.

During removal for the clean out tool the bar 56 provides an abutment of the tool to prevent it snagging on the upper edge of the inlet duct 34.

It will be observed that the guide member 34 by virtue of the open ended channel configuration of the base and wings 54 does not obstruct the flow of liquid from the upstream section 22 into the sump 26. Moreover the provision of the parallel wings 54 presents to the maintenance personnel a guideway that is readily accessible from outside the sump so that it is not necessary for the maintenance personnel to enter the manhole in order to insert the hose. At all times however the integrity of the liquid seal between the upstream and downstream portion is maintained by virtue of the difference in distance of the apertures 38–42 from the floor 28.

The installation described above is intended as a permanent installation but in certain instances it may be convenient to have a portable guide member which may be attached to the inlet ducts for clean out purposes. Such an arrangement is shown in FIGS. 3 through 7 where like reference numerals have been used to denote like components to the embodiment of FIGS. 1 through 2 with a suffix A added for clarity of description. In the arrangement of FIGS. 4 through 8 the inlet duct 34A is provided with a conventional flange 60 having uniformly distributed bolt holes 62. The base 46A of the guide member 44A is connected to a similar flange 64 having a pair of hooks 66–68 welded thereto. As best seen in FIG. 7 each of the hooks 66–68 includes a support member 70 extending generally parallel to the longitudinal access of the guide member and a stop member 72 extending at right angles to the support member. The leading edge 74 of the stop member 72 is chamfered to provide a lead in for the hooks 66–68. The hooks 66–68 are disposed on opposite sides of the axis of symmetry of the guide member 44A and so support the guide member in a stable position.

To prevent rotation of the guide member 44A relative to the inlet duct 34A a pair of locating pins 76 are provided on the flange 64. As best seen in FIG. 6 the locating pins 76 comprise a bolt 78 extending through the bolt holes 62 in the flange 64 and secured in place by means of a weldment 80. The bolts 78 have a diameter considerably smaller than the diameter of the bolt holes 62 and so are loosely received within the bolt holes of the flange 60.

To enable the guide member 44A to be attached to the inlet 34A a telescoping handle 82 is welded to the bar 56A. The telescoping handle includes a female portion 84 welded to the bar 56 and a male portion 86 slidable within the female portion. A pin 88 passes through both the male and female portions to connect the two together and provide a handle of the desired length.

In order to mount the guide member 44A on the inlet duct 34A the handle 82 is assembled and the guide member lowered into the sump 26A. The chamfered portion of the leading edge 74 enables the assembly to be lowered with the bolt 78 clear of the flange 62 until the bolts are received within the bolt holes 62 of the flange 60. Further lowering of the guide member 44A brings the two flanges into sung engagement and enables the hose to be inserted in the manner described above. The handle 82 may also be used during removal of the hose to prevent undue loads being placed upon the hooks 66–68.

It will be seen therefore that in both embodiments of the invention an extremely simple yet reliable guide member is provided that facilitates maintenance operations on the sewer installations without requiring personnel to enter the sump. This is achieved without interfering with the integrity of the liquid seal between the two sections of the sewer.

The embodiments of the invention in which an exclusive property or privilege is claimed are defined as follows:

1. A manhole assembly to provide a liquid seal between two sections of a sewer comprising a floor, an upstanding peripheral wall, an inlet duct extending through said wall, an outlet duct extending through said wall at a location spaced from said inlet duct and having a portion located further from said floor than said inlet duct so as to maintain liquid in said manhole at a predetermined level sufficient to cover said inlet duct, and a guide member to facilitate entry of a cleaning tool into said inlet duct, said guide member comprising a base projecting from said inlet duct and a pair of upstanding wings located on opposite sides of said base to project upwardly to a location above said predetermined level, said wings and base partially surrounding said inlet duct such that a cleaning tool inserted between said wings is guided by said base into said inlet duct.

2. A manhole assembly according to claim 1 wherein said outlet duct intersects said wall at a location further from said floor than said inlet duct.

3. A manhole assembly according to claim 2 wherein said inlet duct is downwardly inclined relative to said peripheral wall.

4. A manhole assembly according to claim 3 wherein said base conforms to the lower portion of said inlet duct.

5. A manhole assembly according to claim 3 wherein both said inlet duct and said base are semi-circular in cross section.

6. A manhole assembly according to claim 5 including a bar extending between said wings adjacent to said inlet duct to inhibit contact of said cleaning tool with an upper portion of said inlet duct.

7. A manhole assembly according to claim 6 wherein said wings are parallel plates.

8. A manhole assembly for providing a liquid seal between two sections of a sewer, said manhole assembly comprising a sump having a floor and an upstanding peripheral wall, a circular inlet duct intersecting said wall at a first location, an outlet duct intersecting said wall at a second location spaced further from said floor than said inlet duct to maintain liquid in said sump at a predetermined level, and a guide member connected to said inlet duct to facilitate entry of a cleaning tool therein, said guide member comprising a base conforming to the lower half of said inlet duct and a pair of plates connected to opposite edges of said base and projecting upwardly above said predetermined level.

* * * * *